US008351808B2

(12) United States Patent
Taguchi

(10) Patent No.: US 8,351,808 B2
(45) Date of Patent: Jan. 8, 2013

(54) IMAGE FORMING APPARATUS USING DIFFERENT SHAPED POSITION MARKS ON TONER IMAGE BELT MEMBER

(75) Inventor: Akio Taguchi, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 290 days.

(21) Appl. No.: 12/839,641

(22) Filed: Jul. 20, 2010

(65) Prior Publication Data

US 2011/0026956 A1 Feb. 3, 2011

(30) Foreign Application Priority Data

Jul. 31, 2009 (JP) ..... 2009-179899

(51) Int. Cl.
*G03G 15/00* (2006.01)

(52) U.S. Cl. ..... 399/49

(58) Field of Classification Search ..... 399/49, 399/58, 301; 347/19
See application file for complete search history.

(56) References Cited

U.S. PATENT DOCUMENTS

| | | | | |
|---|---|---|---|---|
| 7,432,494 | B2 * | 10/2008 | Kanzaki | 250/226 |
| 7,658,462 | B2 * | 2/2010 | Eom | 347/19 |
| 2009/0041493 | A1 * | 2/2009 | Kakutani | 399/58 |

FOREIGN PATENT DOCUMENTS

| | | | |
|---|---|---|---|
| JP | 05-150574 | | 6/1993 |
| JP | 2000132047 | A * | 5/2000 |

* cited by examiner

*Primary Examiner* — Quana M Grainger
(74) *Attorney, Agent, or Firm* — Fitzpatrick, Cella, Harper & Scinto

(57) ABSTRACT

An image forming apparatus includes: a rotatable belt member; a toner image forming unit which forms a toner image on the belt member; a first detection unit which detects the density of the toner image transferred to the belt member; a plurality of position marks which detects a position in the circumferential direction of the belt member; a second detection unit which detects the position marks; a calculation unit which calculates the position in the circumferential direction of the belt member based on a detection result of the second detection unit; and an adjustment unit which adjusts toner image forming conditions of the toner image forming unit based on the output of the first detection unit and the circumferential direction position calculated by the calculation unit; wherein the shape of each of the plurality of position marks is different at each circumferential direction position.

3 Claims, 6 Drawing Sheets

IMAGE FORMING APPARATUS USING DIFFERENT SHAPED POSITION MARKS ON TONER IMAGE BELT MEMBER

BACKGROUND OF THE INVENTION

1. Field of the Invention

The present invention relates to an image forming apparatus of a copying machine or printer which uses an electrophotographic system or an electrostatic recording system. More particularly, the present invention is related to an image forming apparatus capable of recognizing the density of a toner image transferred to an intermediate transfer belt corresponding to a position in the circumferential direction of the intermediate transfer belt.

2. Description of the Related Art

Conventionally, for example, as an image forming apparatus capable of forming a full color image, the following direct transfer-type and intermediate transfer-type image forming apparatuses are known. In a direct transfer-type image forming apparatus, a toner image formed on a single or a plurality of photosensitive drums is transferred to a transfer material carried on a belt member (hereinafter referred to as a "transfer belt"), which is a transfer material bearing member capable of rotating in the circumferential direction. In an intermediate transfer-type image forming apparatus, a toner image formed on a single or a plurality of photosensitive drums is transferred once (primary transfer) to a belt member (hereinafter referred to as an "intermediate transfer belt"), which is an intermediate transfer member capable of rotating in the circumferential direction. Subsequently, in an intermediate transfer-type image forming apparatus, the toner image on the intermediate transfer belt is transferred (secondary transfer) to a transfer material. In an intermediate transfer-type image forming apparatus, it is easy to form an image on various recording materials, and thus the selectivity of the recording material can be increased.

In an image forming apparatus, the density of a patch image is detected by an optical sensor and the image density of the colors is controlled by a control of toner replenishment of developer by a patch detection system or the like, and registration deviation is detected by the optical sensor and registration correction is performed.

Given the above, a constitution of an image forming apparatus which has an intermediate transfer belt and controls the image density based on detection of a patch density by an optical sensor can be envisioned. A technology called ground correction is necessary for the measurement of the patch density transferred to a transfer surface of an intermediate transfer belt by an optical sensor. During measurement of the patch density, ground correction has an effect of canceling the influence from the gloss of the surface of the ground on the patch density, while taking the condition of the ground of the intermediate transfer belt to which the toner is transferred into account. The condition of the ground of the intermediate transfer belt includes, for example, variation over time in the gloss of the transfer surface of the intermediate transfer belt and gloss irregularities in the intermediate transfer belt within one round. In particular, as an invention for canceling the influence from gloss irregularities in the intermediate transfer belt within one round on the patch density, the image forming apparatus disclosed in Japanese Patent Application Laid-Open No. 05-150574 has been proposed.

In the image forming apparatus disclosed in Japanese Patent Application Laid-Open No. 05-150574, before measuring the patch density, a control apparatus reads one round of the transfer surface of the intermediate transfer belt which becomes the ground of the toner image via a density sensor, and then stores the phase of the intermediate transfer belt and the output value of the density sensor for each phase. Subsequently, the control apparatus references the phase of the transfer surface of the intermediate transfer belt and the output value of the density sensor in each phase which were stored to ascertain the output value of the density sensor corresponding to the transfer surface of the intermediate transfer belt of a certain phase which becomes the ground of the toner patch. The control apparatus then performs ground correction to obtain the density of the toner patch.

Further, in the image forming apparatus disclosed in Japanese Patent Application Laid-Open No. 05-150574, in order for the control apparatus to become able to recognize the phase of the transfer surface of the intermediate transfer belt, marks are attached to the intermediate transfer belt at prescribed intervals in the circumferential direction, and a mark detecting sensor which detects the marks is arranged facing the intermediate transfer belt. A calculation unit within the control apparatus determines the current phase of the intermediate transfer belt based on the elapsed time from when the prescribed marks on the intermediate transfer belt are detected by the mark position detecting sensor.

However, when obtaining a profile of one round of the intermediate transfer belt using an optical sensor, a reference position which becomes the reference of the circumferential direction is necessary for the intermediate transfer belt. If there is one mark attached to such a reference position of the intermediate transfer belt, a wait time until the mark comes to the location of the mark detecting sensor occurs. Therefore, in the image forming apparatus disclosed in Japanese Patent Application Laid-Open No. 05-150574, in order to reduce the wait time until the mark comes to the location of the mark detecting sensor, a plurality of marks of the same shape and same pattern are attached to the intermediate transfer belt.

However, the belt position detecting marks cannot be distinguished from each other, and after a power source is suddenly turned OFF or after a process to eliminate a paper jam, the reference position is lost, and the reference position and the profile of one round of the intermediate transfer belt must be retaken, and thus a wait time may occur.

The present invention provides an image forming apparatus which can reduce the time for determining the position of a belt member.

SUMMARY OF THE INVENTION

An image forming apparatus of the present invention includes a rotatable belt member, a toner image forming unit which forms a toner image on the belt member, a first detection unit which is arranged facing the belt member and detects the toner image transferred to the belt member, a plurality of position marks which is provided in the plural points on the belt member in the circumferential direction of the belt member, a second detection unit facing the belt member which detects the position marks, a calculation unit which calculates the position in the circumferential direction of the belt member based on a detection result of the second detection unit, and an adjustment unit which adjusts toner image forming conditions of the toner image forming unit based on the output of the first detection unit and the circumferential direction position calculated by the calculation unit, wherein the circumferential shape of each of the plurality of position marks is different each other.

Further features of the present invention will become apparent from the following description of exemplary embodiments with reference to the attached drawings.

DESCRIPTION OF THE EMBODIMENTS

Exemplary embodiments of the present invention will be described below in detail with reference to the drawings. However, the dimensions, materials, and shapes of the constitutional members and the relative positions thereof described in each embodiment below can be appropriately modified depending on the constitution of the apparatus to which the present invention is applied and various other conditions. Therefore, unless specific descriptions are particularly mentioned, the scope of the present invention is not limited to the embodiments described below.

First Embodiment

Figure 1:
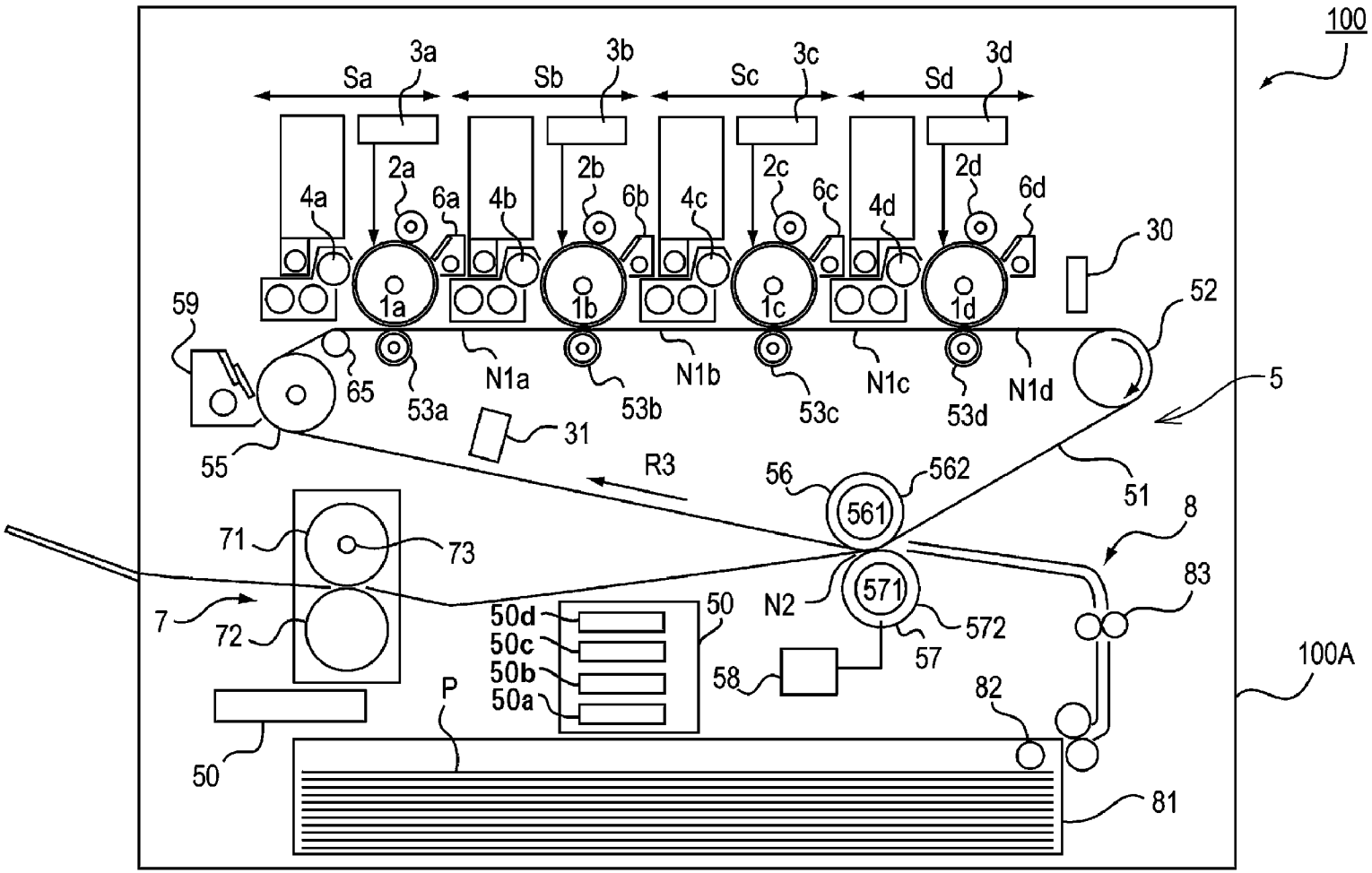
FIG. 1 is a cross-section view illustrating the constitution of an image forming apparatus according to a first embodiment of the present invention.

FIG. 1 is a cross-section view illustrating the constitution of an image forming apparatus 100 according to a first embodiment of the present invention. The image forming apparatus 100 is a full color electrophotographic image forming apparatus which has four photosensitive drums 1*a* to 1*d*, uses an intermediate transfer system, and utilizes an electrophotographic image forming process. As illustrated in FIG. 1, the image forming apparatus 100 has an image forming apparatus main body (hereinafter referred to as "apparatus main body") 100A. The image forming apparatus 100 has "a plurality of", i.e. four, "image forming portions", which are a first image forming portion Sa, a second image forming portion Sb, a third image forming portion Sc, and a fourth image forming portion Sd, within the apparatus main body 100A. Each image forming portion Sa, Sb, Sc, Sd is for forming each color of yellow, magenta, cyan, and black, respectively. In the first embodiment, the constitutions of the image forming portions Sa to Sd are substantially the same except that the color of toner used is different. Accordingly, in the following description, if it is not particularly necessary to distinguish them, the additional letters a, b, c, and d added to the reference numerals will be omitted and the term of the image forming portions S will be generally used in order to show that these are an element provided for one of the colors.

The image forming portions S are equipped with photosensitive drums 1*a* to 1*d*, which are a plurality of "image bearing members" on whose surface toner images are formed. On the periphery of the photosensitive drums 1, charging rollers 2*a* to 2*d* as first charging portions and laser scanners 3*a* to 3*d* as exposing portions are arranged sequentially along the rotation direction of the photosensitive drums 1. Further, on the periphery of the photosensitive drums 1, developing apparatuses 4*a* to 4*d* as developing units and drum cleaners 6*a* to 6*d* as drum cleaning units are arranged sequentially along the rotation direction of the photosensitive drums 1. An intermediate transfer belt 51, which is an endless "belt member" having a transfer surface 51*a* (refer to FIG. 2) onto which the toner images of the plurality of photosensitive drums 1*a* to 1*d* are transferred is arranged facing (adjacent to) the plurality of photosensitive drums 1*a* to 1*d*. The image forming portions have a function as a toner image forming unit which forms a toner image on the intermediate transfer belt 51.

The intermediate transfer belt 51 is stretched over a drive roller 52, a tensing roller 55, a secondary transfer inner roller 56, and an upstream control roller 65, which act as a plurality of support members. A driving force is transmitted to the intermediate transfer belt 51 by the drive roller 52, which is a belt driving unit, to move the belt 51 in a rotating fashion in the direction of arrow R3. Primary transfer rollers 53*a* to 53*d* are arranged as primary transfer members at positions opposite to the photosensitive drums 1*a* to 1*d* on the inner circumferential side of the intermediate transfer belt 51. The intermediate transfer belt 51 is biased toward the photosensitive drums 1*a* to 1*d* by the primary transfer rollers 53*a* to 53*d*, and primary transfer portions (primary transfer nips) N1*a* to N1*d*, at which the photosensitive drums 1*a* to 1*d* contact the intermediate transfer belt 51, are formed. Further, a secondary transfer outer roller 57 is arranged as a secondary transfer member at a position opposite to the secondary transfer inner roller 56 on the outer circumferential side of the intermediate transfer belt 51. The secondary transfer outer roller 57 contacts the outer circumferential surface of the intermediate transfer belt 51 to form a secondary transfer portion (secondary transfer nip) N2. Images on the photosensitive drums 1*a* to 1*d* formed by the image forming portions Sa to Sd are successively multi-layer transferred (primary transfer step) onto the intermediate transfer belt 51 contacting and passing over the photosensitive drums 1*a* to 1*d*. Subsequently, the images transferred onto the intermediate transfer belt 51 are further transferred (secondary transfer step) to a recording material P, such as paper, at the secondary transfer portion N2.

The image forming apparatus 100 described above operates as described below. First, in the case of forming a full color image, the photosensitive drums 1*a* to 1*d* are uniformly charged by the charging rollers 2*a* to 2*d*, and then light exposure in accordance with an image signal is carried out by the laser scanners 3*a* to 3*d*. Thereby, electrostatic images are formed on the photosensitive drums 1*a* to 1*d*. Subsequently, toner images are developed by the developing apparatuses 4*a* to 4*d*, and a transfer bias is applied from a transfer high-voltage power source (not illustrated) to the primary transfer rollers 53*a* to 53*d* to successively transfer the toner images on the photosensitive drums 1*a* to 1*d* to the intermediate transfer belt 51. At this time, the intermediate transfer belt 51 is arranged to be in contact with the photosensitive drums 1*a* to 1*d* of the four colors due to the placement of the upstream control roller 65 which control the position of the intermediate transfer belt 51. The transfer residual toner remaining on the photosensitive drums 1*a* to 1*d* is collected by the drum cleaners 6*a* to 6*d*. The images successively multi-layer transferred onto the intermediate transfer belt 51 from each photosensitive drum 1*a* to 1*d* by the above-described procedures are transferred to the recording material P by the application of a secondary transfer bias between the secondary transfer inner roller 56 and the secondary transfer outer roller 57, which are the secondary transfer members. The toner images on the recording material P are fixed by a fixing apparatus 7, and thereby a full color image is obtained.

In the image forming apparatus 100, the density of a patch image is detected by an optical sensor 30, and the image density of the colors is controlled by a control of toner replenishment of developer by a patch detection system, and registration deviation is detected by the optical sensor 30 and registration correction is performed.

Figure 2:
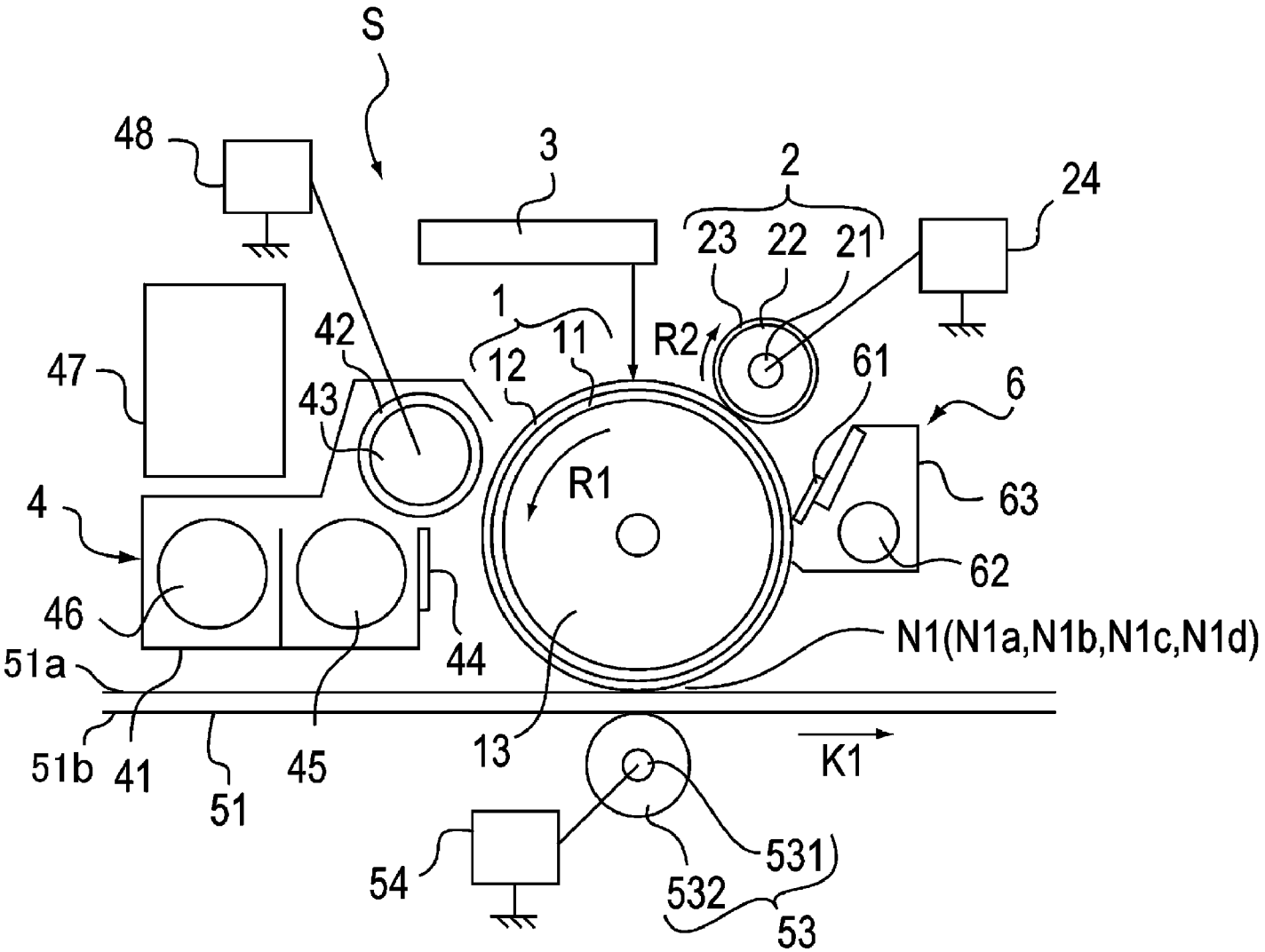
FIG. 2 is an enlarged cross-section view of FIG. 1 illustrating the constitution of an image forming portion.

FIG. 2 is an expanded cross-section view of FIG. 1 illustrating the constitution of the image forming portion S. The photosensitive drum 1 is rotatably supported by the apparatus main body 100A (refer to FIG. 1). As illustrated in FIG. 2, the photosensitive drum 1 is a cylindrical electrophotographic photosensitive member basically including an aluminum conductive substrate 11 and a photoconductive layer 12 formed on the outer circumference of the substrate 11. The photosensitive drum 1 has a shaft 13 at its center. The photosensitive drum 1 is rotatably driven in the direction of arrow R1 centered on the shaft 13 by a driving unit (not illustrated). In the first embodiment, the charging polarity of the photosensitive drum 1 is negative.

A charging roller 2 is arranged above the photosensitive drum 1 as a primary charging portion. The charging roller 2 abuts the surface of the photosensitive drum 1, and uniformly charges the surface of the photosensitive drum 1 with a prescribed polarity and potential. The charging roller 2 has a conductive metal core 21 positioned in the center, a low resistivity conductive layer 22 formed on the outer circumference of the core 21, and a mid resistivity conductive layer 23, and the charging roller 2 is formed overall in a roller shape. In the charging roller 2, both ends of the metal core 21 are rotatably supported by shaft bearing members (not illustrated), and arranged parallel to the photosensitive drum 1. The shaft bearing members of both ends are biased toward the photosensitive drum 1 by a compression unit (not illustrated). Thereby, the charging roller 2 is pressed to the surface of the photosensitive drum 1 with a prescribed compressive force. The charging roller 2 dependently rotates in the direction of arrow R2 in accordance with the rotation in the direction of arrow R1 of the photosensitive drum 1. A charging bias voltage is applied to the charging roller 2 by a charging bias power source 24, which is a charging bias output unit. Thereby, the surface of the photosensitive drum 1 is uniformly contact charged.

A laser scanner 3 is arranged on the downstream side of the charging roller 2 in the rotation direction of the photosensitive drum 1. The laser scanner 3 scans while turning a laser beam ON and OFF based on image information, and exposes light on the photosensitive drum 1. Thereby, an electrostatic image (latent image) according to the image information is formed on the photosensitive drum 1.

A developing apparatus 4 is arranged on the downstream side of the laser scanner 3 in the rotation direction of the photosensitive drum 1. The developing apparatus 4 has a developing container 41 which contains a two-component developer including non-magnetic toner particles (toner) and magnetic carrier particles (carrier) as developer. A developing sleeve 42 as a developer bearing member is rotatably arranged within an opening of the developing container 41 facing the photosensitive drum 1. A magnet roller 43 as a magnetic field source unit is fixedly arranged within the developing sleeve 42 so that it cannot rotate relative to the rotation of the developing sleeve 42. The two-component developer is carried on the developing sleeve 42 by the magnetic field formed by the magnet roller 43. A control blade 44, which is a developer control member for controlling and thinning the two-component developer carried on the developing sleeve 42, is arranged under the developing sleeve 42. The inside of the developing container 41 is divided into a developing chamber 45 and a stirring chamber 46, and a replenishing chamber 47 which contains toner for replenishment is provided above the two chambers 46 and 47. The replenishing chamber 47 replenishes toner to the stirring chamber 46 during image density control by a patch detection system, and is used for toner replenishment control which maintains the toner density of the developer within the developing container 41 at a prescribed value.

A thin layer of the two-component developer on the developing sleeve 42 is conveyed to a developing region opposite to the photosensitive drum 1 in accordance with the rotation of the developing sleeve 42. The two-component developer on the developing sleeve 42 rises up in brush shape in the developing region by the magnetic force of the developing main pole of the magnet roller 43 positioned in the developing region, and a magnetic brush of the two-component developer is formed. The surface of the photosensitive drum 1 is abraded by the magnetic brush, and a developing bias voltage is applied to the developing sleeve 42 by a developing bias power source 48, which is a developing bias output unit. Thereby, toner attached to a carrier which constitutes the head of the magnetic brush attaches to the exposure portion of the electrostatic image on the photosensitive drum 1 to form a toner image. In the first embodiment, a toner image is formed on the photosensitive drum 1 by reversal development in which toner which is charged to the same polarity as the charging polarity of the photosensitive drum 1 is attached to portions on the photosensitive drum 1 at which the electric charge is attenuated by light exposure.

A primary transfer roller 53 is arranged below the photosensitive drum 1 on the downstream side of the developing apparatus 4 in the rotation direction of the photosensitive drum 1. The primary transfer roller 53 includes a metal core 531 and a conductive layer 532 formed in a cylindrical shape on the outer circumference of the core 531. Both ends of the primary transfer roller 53 are biased toward the photosensitive drum 1 by a compression member (not illustrated) such as a spring. Thereby, the conductive layer 532 of the primary transfer roller 53 is pressed to the surface of the photosensitive drum 1 via the intermediate transfer belt 51 with a prescribed compressive force. A primary transfer bias power source 54 is connected as a primary transfer bias output unit to the metal core 531. A primary transfer portion N1 (N1*a*, N1*b*, N1*c*, N1*d*) is formed between the photosensitive drum 1 and the primary transfer roller 53. The intermediate transfer belt 51 is sandwiched at the primary transfer portion N1. The intermediate transfer belt 51 moves in the direction of arrow K1. The primary transfer roller 53 contacts the inner circumferential surface of the intermediate transfer belt 51 and rotates in accordance with the movement of the intermediate transfer belt 51. During image formation, a primary transfer bias voltage, which is of an opposite polarity (second polarity: positive polarity in the first embodiment) relative to the normal charging polarity (first polarity: negative polarity in the first embodiment) of the toner, is applied to the primary transfer roller 53 by the primary transfer bias power source 54. A magnetic field is then formed in between the primary transfer roller 53 and the photosensitive drum 1 in a direction which makes the toner of the first polarity move from the photosensitive drum 1 to the intermediate transfer belt 51. Thereby, the toner image on the photosensitive drum 1 is transferred (primary transfer) to the surface of the intermediate transfer belt 51 (primary transfer step). The process speed corresponding to the surface movement speed of the photosensitive drum 1 and the intermediate transfer belt 51 is 200 mm/sec.

Deposits such as toner (primary transfer residual toner) remaining on the surface of the photosensitive drum 1 after the primary transfer step are cleaned by the drum cleaner 6. The drum cleaner 6 has a cleaning blade 61 as a drum cleaning member, a conveying screw 62, and a drum cleaner housing 63. The cleaning blade 61 is abutted to the photosensitive drum 1 at a prescribed angle and pressure by a pressure unit (not illustrated). Thereby, toner remaining on the surface of the photosensitive drum 1 is scratched off and removed from the photosensitive drum 1 by the cleaning blade 61, and then collected within the drum cleaner housing 63. Toner which has been collected is conveyed by the conveying screw 62 and discharged to a discharge toner receptacle (not illustrated).

Returning to FIG. 1, the constitution of the inside of the apparatus main body 100A of the image forming apparatus 100 will be described below. As illustrated in FIG. 1, below the photosensitive drums 1*a* to 1*d*, the intermediate transfer belt 51, the primary transfer rollers 53*a* to 53*d*, the secondary transfer inner roller 56, the secondary transfer outer roller 57, the intermediate transfer belt cleaner 59, and the like are arranged to constitute an intermediate transfer unit 5. The secondary transfer inner roller is electrically connected. Further, a secondary transfer bias power source 58 is connected as a secondary transfer bias output unit to the secondary transfer outer roller 57. The secondary transfer inner roller 56 contacts the inner circumferential surface of the intermediate transfer belt 51 and rotates in accordance with the movement of the intermediate transfer belt 51.

For example, during formation of a full color image, a toner image of each color is formed on the photosensitive drums 1*a* to 1*d* of the first to fourth image forming portions Sa to Sd. The toner images of each color receive a primary transfer bias from the primary transfer rollers 53 which are opposite to the photosensitive drums 1*a* to 1*d* to sandwich the intermediate transfer belt 51, and then are transferred (primary transfer) successively onto the intermediate transfer belt 51. These toner images are conveyed to the secondary transfer portion N2 in accordance with the rotation of the intermediate transfer belt 51.

Meanwhile, by this time, the recording material P is conveyed to the secondary transfer portion N2 by a recording material supply unit 8. Basically, in the recording material supply unit 8, the recording material P, which is removed one sheet at a time by a pick up roller 82 from a cassette 81, which is a recording material container, is conveyed to the secondary transfer portion N2 by a conveying roller 83.

During image formation, a secondary transfer bias voltage, which is of an opposite polarity (second polarity: positive polarity in the first embodiment) relative to the normal charging polarity (first polarity: negative polarity in the first embodiment) of the toner, is applied to the secondary transfer outer roller 57 by the secondary transfer bias power source 58. A magnetic field is then formed in between the secondary transfer inner roller 56 and the secondary transfer outer roller 57 in a direction which makes the toner of the first polarity move from the intermediate transfer belt 51 to the recording material P. Thereby, the toner images on the intermediate transfer belt 51 are transferred (secondary transfer) to the recording material P. The recording material P, onto which the toner images have been transferred at the secondary transfer portion N2 is conveyed to the fixing apparatus 7, which is a fixing unit.

Deposits such as toner (secondary transfer residual toner) remaining on the outer circumferential surface of the intermediate transfer belt 51 after the secondary transfer step are removed and collected by the intermediate transfer belt cleaner 59. The intermediate transfer belt cleaner 59 has the same constitution as the drum cleaner 6.

The fixing apparatus 7 has a fixing roller 71 which is rotatably mounted and a pressure roller 72 which rotates while pressed to the fixing roller 71. A heater 73 such as a halogen lamp is arranged within the fixing roller 71. Temperature adjustment of the surface of the fixing roller 71 is carried out by controlling the voltage supplied to the heater 73. When the recording material P is conveyed to the fixing apparatus 7, while the recording material P passes between the fixing roller 71 and the pressure roller 72 which rotate at a fixed speed, the recording material P is compressed and heated at an approximately fixed pressure and fixed temperature from both the top and bottom surfaces. Thereby, the unfixed toner images on the surface of the recording material P are fused and fixed to the recording material P. In this way, a full color image is formed on the recording material P.

The intermediate transfer belt 51 can include a dielectric resin such as PC (polycarbonate), PET (polyethylene terephthalate), and PVDF (polyvinylidene fluoride). As the intermediate transfer belt 51, a belt formed by a PI (polyimide) resin having a thickness of 100 μm and a surface resistivity of $10^{12}\Omega/\square$ (using a JIS-K6911 compliant probe, an applied voltage of 100 V, an applied time of 60 sec, 23° C./50% RH) is used. However, the belt is not limited to this constitution, and a belt of another material having another volume resistivity and thickness may be used.

As illustrated in FIG. 2, the primary transfer roller 53 includes the metal core 531 having an outer diameter of 8 mm, and the conductive layer 532 formed by a conductive urethane sponge having a thickness of 4 mm. The electrical resistivity of the primary transfer roller 53 was approximately $10^5\Omega$ (23° C./50% RH). The electrical resistivity of the primary transfer roller 53 is calculated from the current value measured when the primary transfer roller 53, which is abutted by a metal roller grounded under a load of 500 g, is rotated at a circumferential speed of 50 mm/sec and a 100 V voltage is applied to the metal core 531.

As illustrated in FIG. 1, the secondary transfer inner roller 56 includes a metal core 561 having an outer diameter of 18 mm, and a conductive, solid silicone rubber layer 562 having a thickness of 2 mm. The electrical resistivity of the secondary transfer inner roller 56 was approximately $10^4\Omega$ as measured by the same measurement method as the primary transfer roller 53.

As illustrated in FIG. 1, the secondary transfer outer roller 57 includes a metal core 571 having an outer diameter of 20 mm, and a conductive EPDM rubber sponge layer 572 having a thickness of 4 mm. The electrical resistivity of the secondary transfer outer roller 57 was approximately $10^8\Omega$ as measured by the same measurement method as the primary transfer roller 53 when the voltage applied was 2000 V.

Figure 3A:
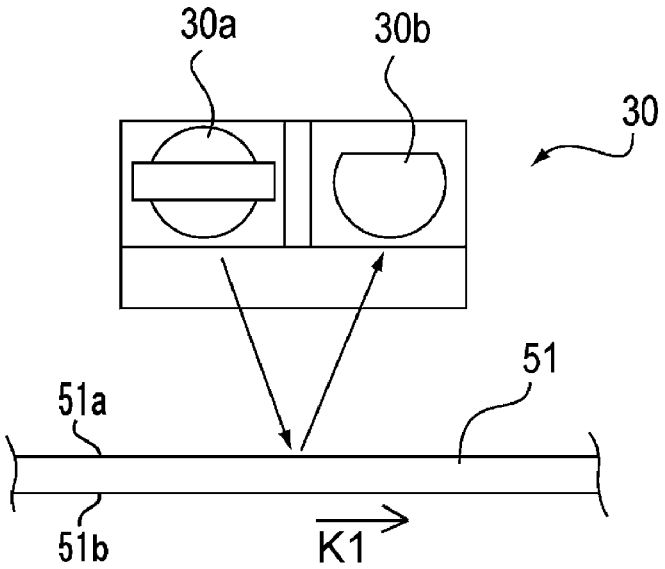
FIGS. 3A and 3B are cross-section views illustrating the constitution of an optical sensor.

FIG. 3A is a cross-section view illustrating the constitution of the optical sensor 30. As illustrated in FIG. 3A, the optical sensor 30, which is a "first detection unit", is a sensor which faces a transfer surface 51*a* of the intermediate transfer belt and is capable of detecting the density of toner images transferred onto the transfer surface 51*a*. The optical sensor 30 faces the transfer surface 51*a* of the intermediate transfer belt 51, and one optical sensor 30 is arranged between the primary transfer portion N1*d* for black, which is the fourth and last color, and the secondary transfer portion N2 (refer to FIG. 1) and exhibits a function for detecting a patch. The optical sensor 30 can detect the density of a patch image by black toner formed on the surface of the photosensitive drum 1*d*, as well as that of a patch image by yellow-, magenta-, and cyan-colored toner formed on the surfaces of the photosensitive drums 1*a*, 1*b*, 1*c*. The optical sensor 30 can also detect the density of the ground of the intermediate transfer belt 51.

The optical sensor 30 includes a light-emitting element 30*a* and a light-receiving element 30*b*. The light-emitting element 30*a* irradiates light on the patch image of the transfer surface 51*a* of the intermediate transfer belt 51. The light is regularly reflected or diffusedly reflected at parts of the patch image on the surface of the intermediate transfer belt 51, or it is regularly and diffusedly reflected, and then proceeds to the light-receiving element 30*b* in a prescribed reflected light quantity. The light-receiving element 30*b* receives the reflected light quantity and generates an electrical signal (image density signal). The light-receiving element 30*b* is connected to a density storage portion 50*a* of a controller 50.

The controller 50 illustrated in FIG. 1 will be described below. The controller 50 includes a density storage portion 50*a*, a signal processing portion 50*d*, a position calculation portion 50*b*, and a condition changing portion 50*c*. The density storage portion 50*a*, which is a "storage unit", is a part for storing detection results of the optical sensor 30 as density information, which is a "profile" covering one round of the intermediate transfer belt 51. The controller 50 amplifies an electrical signal to a prescribed reference value with the signal processing portion 50*b* within the controller 50, and then stores this in the density storage portion 50*a* as an amplification factor. The controller 50 provides feedback for image forming conditions based on the obtained electrical signal, and controls the image density by controlling toner replenishment to developer and controlling conditions such as light exposure of a latent image and developing bias. During installation of the apparatus main body 100A or exchange of the intermediate transfer belt 51, first, a profile of reflected light quantity (brightness) of the intermediate transfer belt 51 is initially set.

A technology called ground correction is necessary for the measurement of the patch density transferred to the transfer surface 51*a* of the intermediate transfer belt 51 by the optical sensor 30. During measurement of the patch density, ground correction has an effect of canceling the influence from the gloss of the surface of the ground on the patch density, while taking the condition of the ground of the intermediate transfer belt 51 to which the toner is transferred into account. The condition of the ground of the intermediate transfer belt 51 includes, for example, variation over time in the gloss of the transfer surface 51*a* of the intermediate transfer belt and gloss irregularities in the intermediate transfer belt 51 within one round.

In a state in which the output value of a sensor in the ground directly below the toner patch of the intermediate transfer belt 51 has been ascertained, ground correction (density correction) is carried out by the method described below, for example. When a regularly reflected light output R10 (toner patch) exists during toner patch detection and a regularly reflected light output R20 (ground directly under toner patch) exists during detection of the ground directly under the toner patch, the toner patch density DENS (toner patch) is calculated by the following formula (1):

[Equation 1]

$$\text{DENS(toner patch)}=R10\text{(toner patch)}\div R20\text{(ground directly under toner patch)} \quad (1)$$

Figure 3B:
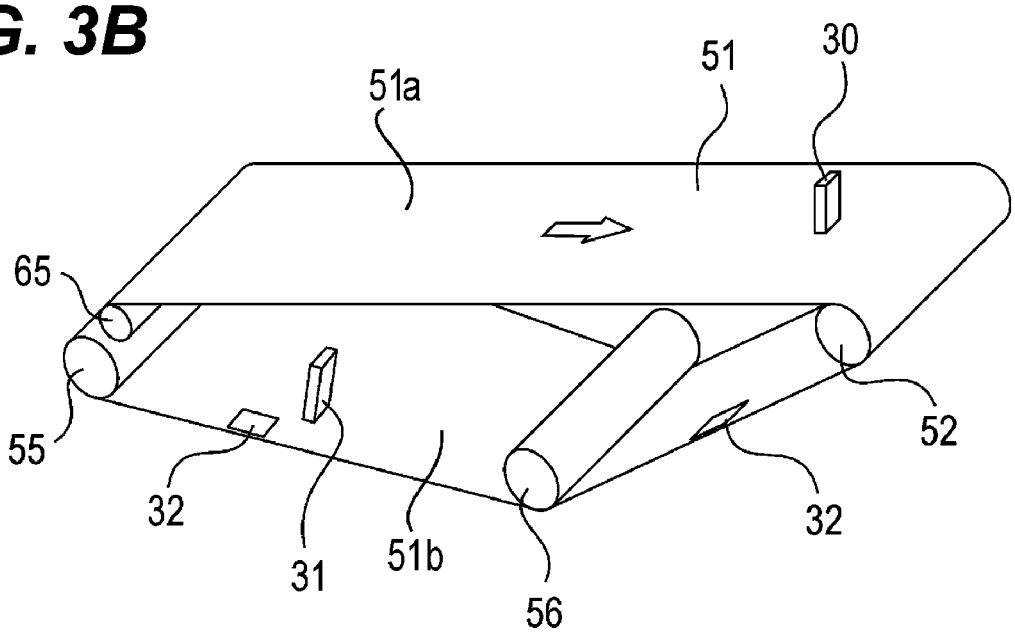

FIG. 3B is a perspective view illustrating the constitution of a reference position detection sensor 31. As illustrated in FIG. 3B, a plurality of blank seals 32 are arranged on the edge of an opposite surface 51*b* on the opposite side of the transfer surface 51*a* of the intermediate transfer belt 51 in a direction orthogonal to the direction of arrow K1, which is the direction of movement of the intermediate transfer belt 51. The blank seals 32, which are a plurality of "position marks", show the circumferential direction position, which is the position in the circumferential direction of the intermediate transfer belt 51. The blank seals 32 are utilized in order to obtain an output of the optical sensor 30 for one round of the intermediate transfer belt 51. The shape of each of the blank seals 32 will be described in detail below, but basically the shapes are different at each circumferential direction position, and thus the circumferential direction position of the intermediate transfer belt 51 can be identified.

A reference position detection sensor 31, which is a "second detection unit" capable of detecting the blank seals 32, is arranged facing the intermediate transfer belt 51. The reference position detection sensor 31 exhibits a function as a sensor which detects the reference position of the intermediate transfer belt 51. The reference position detection sensor 31 is connected to the position calculation portion 50*b* (refer to FIG. 1) of the controller 50.

The above-described controller 50 will be described in further detail below. The position calculation portion 50*b*, which is a "calculation unit", is a part which calculates the circumferential direction position of the intermediate transfer belt 51 based on a detection result of the reference position detection sensor 31. The controller 50 calculates the reference position of the intermediate transfer belt 51 by detecting the reflected quantity of the blank seals with the reference position detection sensor 31. Until the next blank seal 32 comes, the position calculation portion 50*b* for calculating the reference position in the controller 50 calculates the position in the circumferential direction of the intermediate transfer belt 51 from the rotation time and speed of the intermediate transfer belt 51. In other words, the controller 50 determines the current phase of the intermediate transfer belt 51 by the elapsed time from after the reference position detection sensor 31 detects the reference position of the opposite surface 51*b* of the intermediate transfer belt 51 and detects the position in the circumferential direction of the intermediate transfer belt 51.

The above-described condition changing portion 50*c*, which is a "changing unit", is a part which changes the conditions of the toner images formed on the plurality of photosensitive drums 1*a* to 1*d* based on density information, which is a "profile" stored in the density storage portion 50*a*, and the circumferential direction position calculated by the position calculation portion 50*b*. The controller 50 performs ground correction of the intermediate transfer belt 51 based on the density of the toner patch corresponding to the obtained phase of the intermediate transfer belt 51.

First, in a state in which there are no deposits of toner on the intermediate transfer belt 51, the reference position detection sensor 31 detects the blank seals 32. Subsequently, the optical sensor 30, as an "optical density detection unit" which is a "first detection unit", measures the reflected light quantity of the intermediate transfer belt 51 over one round of the intermediate transfer belt 51, and then stores the output profile at that time in the density storage portion 50*a* (control memory).

Next, initial setting of the developer density is carried out. The initial setting of the developer density is also normally carried out during installation of the apparatus main body 100A or exchange of the developer. A latent image of the patch image, which is a reference image for image density control, is formed on the photosensitive drum 1, and then a developing bias is applied to the developing sleeve 42 of the developing apparatus 4 to develop a patch latent image, and thereby a patch image after primary transfer is obtained. After the reflected light quantity from the patch image is measured by the optical sensor 30, the reflected light quantity of the intermediate transfer belt 51 at the patch image formation position is calculated from the output from the above-described reference position detection sensor 31 and the stored reflected light quantity profile of the intermediate transfer belt 51. Next, the patch image density is calculated from Formula (1). The image density signal is read as an initial setting value, and then stored in a control memory (not illustrated).

Next, after use in image formation, at an appropriate time, for example, after every certain number of sheets of image formation, a patch image is formed, the reflected light quantity of the patch image is measured with the optical sensor 30, and the patch image density is calculated from Formula (1) using the reflected light quantity of the patch image formation position. The obtained image density signal is then compared with an initial value, the comparison result is fed back to the image formation conditions, and then the image density is controlled by controlling toner replenishment to developer and controlling conditions such as light exposure of a latent image and developing bias. Here, a regular reflection-type of sensor was used as the optical sensor 30, but the optical sensor 30 is not limited to a regular reflection-type.

Figure 4A:
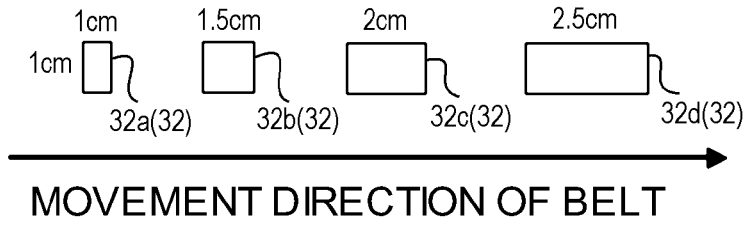
FIGS. 4A to 4C are schematic views illustrating the shapes of blank seals extending in the circumferential direction of an intermediate transfer belt.

FIG. 4A is a schematic view illustrating the shapes of blank seals 32 extending in the circumferential direction of the intermediate transfer belt 51. As illustrated in FIG. 4A, for the blank seals 32 as "belt position detecting marks", which are "position marks", seals having different lengths in the circumferential direction of the intermediate transfer belt 51 are used. In this way, since the dimensions in the circumferential direction of the intermediate transfer belt 51 are different, the shapes of each of the blank seals 32 are different. For example, four types of the blank seals 32 can be used. When expressed in terms of the length in the width direction of the intermediate transfer belt 51×the length in the circumferential direction of the intermediate transfer belt 51, the dimensions of the blank seals 32 are 1 cm×1 cm, 1 cm×1.5 cm, 1 cm×2 cm, and 1 cm×2.5 cm. Here, the blank seals 32 are used as the "position marks", but the "position marks" are not limited to the blanks seals 32. The "position marks" are provided for ascertaining the reference position of the intermediate transfer belt 51, and although they are not used here for the timing of image formation, they can be used for the timing of image formation. As discussed above with reference to FIG. 3B, an optical sensor is used as the reference position detection sensor 31, which functions as the "belt position mark detection sensor", which is the "second detection unit". Since the length in the circumferential direction of the intermediate transfer belt 51 of each of the blank seals 32 is different, when the reference position detection sensor 31 irradiates light on each of the four blank seals 32 described above, the reflection time from the blank seals 32 changes. The reference position detection sensor 31 can distinguish between each of the blank seals 32 by the difference in the reflection time.

Figure 4B:
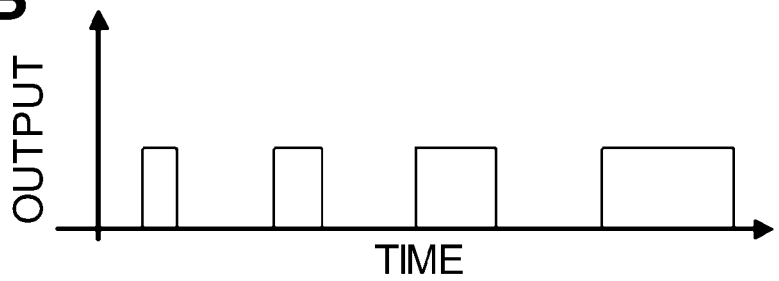

FIG. 4B is a graph illustrating the relationship of the pattern output from the reference position detection sensor 31 and the time. As illustrated in FIG. 4B, the output of the reference position detection sensor 31 corresponds to the dimensions of the blank seals 32 in the width direction of the intermediate transfer belt 51, and the time of output corresponds to the dimensions of the blank seals 32 in the circumferential direction of the intermediate transfer belt 51.

Figure 4C:
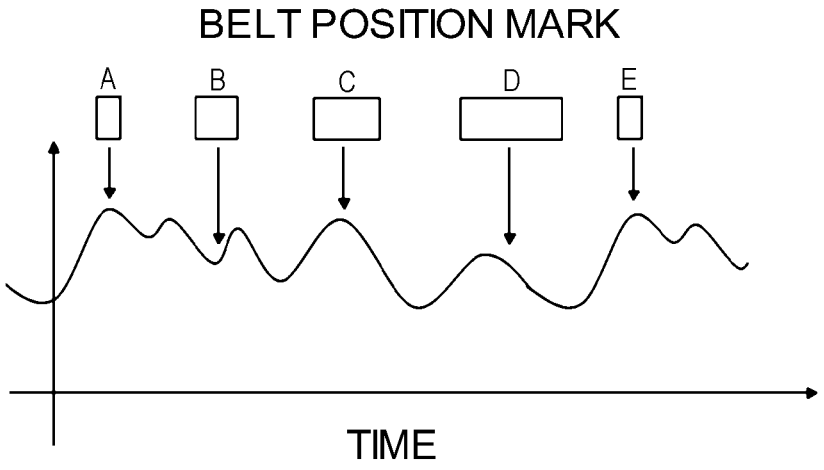

FIG. 4C is a graph illustrating the relationship of the belt ground output of the intermediate transfer belt 51 and the time. Upon entering a sequence in which the profile of the light reflectance of the ground of the intermediate transfer belt 51 is acquired, the controller 50 receives and stores detection information of the blank seals 32 detected by the reference position detection sensor 31, and then begins to acquire the profile of one round of the intermediate transfer belt 51. As illustrated in FIG. 4C, each time the controller 50 detects a blank seal 32 having a different shape, the position of the profile corresponding to the blank seal 32 is stored. The acquisition of the profile is complete once a blank seal 32 having the same shape is obtained again.

By this sequence, regardless of when the patch image was transferred to the intermediate transfer belt 51, the controller 50 can calculate the position of the intermediate transfer belt 51 from the elapsed time after a blank seal 32 has passed and the rotation speed of the intermediate transfer belt 51. As a result, the controller 50 can derive a profile corresponding to the position of the intermediate transfer belt 51 at each position in the circumferential direction of the intermediate transfer belt 51.

For example, when a patch image is actually transferred onto the intermediate transfer belt 51, the controller 50 operates as described below in order to retrieve a profile of the ground directly below the patch image. The controller 50 calculates the absolute position on the intermediate transfer belt 51 from the timing at which the patch image was imaged and the elapsed time from the time at which the reference position detection sensor 31 lastly detected a blank seal 32. The controller 50 then finds the belt ground reflection efficiency in the corresponding profile from FIG. 4C based on the absolute position. Thereby, the controller 50 can calculate the actual density of the patch image from the above-described Formula (1). In the first embodiment, the light reflectance profile of the belt ground is used as the profile for one round of the intermediate transfer belt 51, but the present invention is not limited to this constitution.

[Timing of the Profile Acquisition Sequence for One Round of the Intermediate Transfer Belt 51]

Regarding the timing for measuring the light reflection profile of the intermediate transfer belt 51, this measurement is carried out during installation of the apparatus main body 100A, during exchange of the intermediate transfer belt 51, and at intervals sufficiently longer than the patch image formation frequency. For example, if the patch image formation frequency is set at intervals of every 100 sheets of image formation, the frequency of measuring the profile of one round of the intermediate transfer belt 51 is set at intervals of every 10,000 sheets of image formation. However, the measurement timing is not limited to this timing.

In the first embodiment, the reflectance of the belt ground was used as the profile of one round of the intermediate transfer belt 51. However, the profile is not limited to the reflectance, and the thickness profile of the intermediate transfer belt 51 can be detected and this can be fed back to the belt rotation speed.

Second Embodiment

Figure 5A:
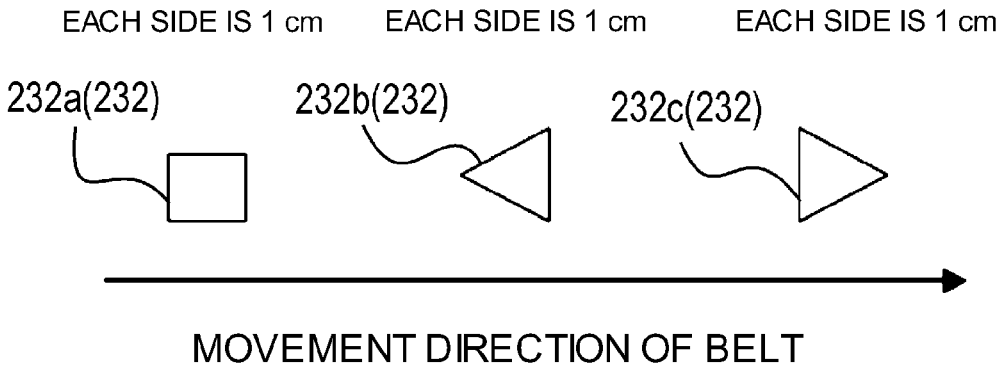
FIGS. 5A and 5B are schematic views illustrating the shapes of blank seals of an intermediate transfer belt according to a second embodiment.

FIG. 5A is a schematic view illustrating the shapes of blank seals 232 of the intermediate transfer belt 51 according to a second embodiment. In the explanation below about the image forming apparatus of the second embodiment, constitutions and effects of the image forming apparatus of the second embodiment which are identical to those of the image forming apparatus 100 of the first embodiment will be assigned identical reference numerals, and descriptions thereof will be appropriately omitted. The image forming apparatus of the second embodiment differs from the image forming apparatus 100 of the first embodiment in that the shapes of each of the blank seals 232*a* to 232*c* differ from each other in their dimensions in the width direction of the intermediate transfer belt 51. In more detail, in the image forming apparatus of the second embodiment, the shape of the first blank seal 232*a* among the blank seals 232, which function as "belt position detection marks", which are "position marks", is a square shape. The shape of the second blank seal 232*b* is a triangle shape which is convex toward the upstream side in the circumferential direction of the intermediate transfer belt 51. The shape of the third blank seal 232*c* is a triangle shape which is convex toward the downstream side in the circumferential direction of the intermediate transfer belt 51. In this way, the light reflectance of each of the blank seals 32 is different at each position in the circumferential direction, and thus the circumferential direction position of the intermediate transfer belt 51 can be identified. Thereby, in the image forming apparatus of the second embodiment, the position of the intermediate transfer belt 51 can be derived from the shapes of the blank seals 232*a* to 232*c*.

In further detail, three types of seals having different shapes are used for the blank seals 232*a* to 232*c*. The blank seal 232*a* is a square in which each side is 1 cm. The blank seal 232*b* is an equilateral triangle in which each side is 1 cm formed to be convex toward the upstream side in the circumferential direction of the intermediate transfer belt 51. The blank seal 232*c* is an equilateral triangle in which each side is 1 cm formed to be convex toward the downstream side in the circumferential direction of the intermediate transfer belt 51. However, the blank seals are not limited to these shapes. As discussed above with reference to FIG. 3B, an optical sensor is used as the reference position detection sensor 31, which functions as a "belt position mark detection sensor", which is the "second detection unit". Since the shape of each of the blank seals 232*a* to 232*c* is different, when the reference position detection sensor 31 irradiates light on each of the three blank seals 232*a* to 232*c* described above, the reflection intensity from the blank seals 232*a* to 232*c* changes. The reference position detection sensor 31 can distinguish between each of the blank seals 232*a* to 232*c* by the difference in the reflection intensity.

Figure 5B:
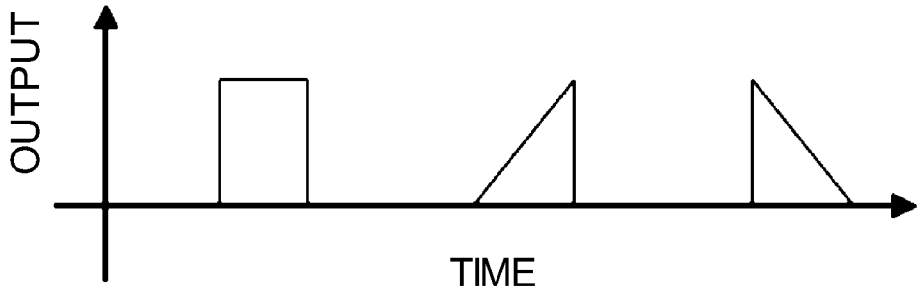

FIG. 5B is a graph illustrating the relationship of the pattern output from the reference position detection sensor 31 and the time. As illustrated in FIG. 5B, the output of the reference position detection sensor 31 corresponds to the dimensions of the blank seals 32 in the width direction of the intermediate transfer belt 51, and the time of output corresponds to the dimensions of the blank seals 32 in the circumferential direction of the intermediate transfer belt 51.

Third Embodiment

Figure 6A:
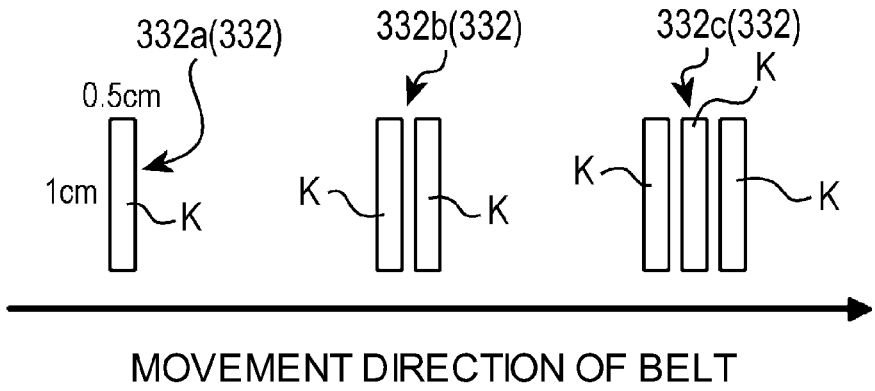
FIGS. 6A and 6B are schematic views illustrating the shapes of blank seals of an intermediate transfer belt according to a third embodiment.

FIG. 6A is a schematic view illustrating the shapes of blank seals 332 of the intermediate transfer belt 51 according to a third embodiment. In the explanation below about the image forming apparatus of the third embodiment, constitutions and effects of the image forming apparatus of the third embodiment which are identical to those of the image forming apparatus 100 of the first embodiment will be assigned identical reference numerals, and descriptions thereof will be appropriately omitted. The image forming apparatus of the third embodiment differs from the image forming apparatus 100 of the first embodiment in that the number of unit figures K extending in the width direction of the intermediate transfer belt 51 which constitute each of the blank seals 332*a* to 332*c* differs in each of the blank seals 332*a* to 332*c*. In more detail, the shape of the first blank seal 332*a* among the blank seals 332, which function as "belt position detection marks", which are "position marks", is a first pattern including one rectangular unit figure K extending in a strip shape in the axial direction of the photosensitive drums 1. The shape of the second blank seal 332*b* is a second pattern including two rectangular unit figures K extending in a strip shape in the width direction of the intermediate transfer belt 51. The shape of the third blank seal 332*c* is a third pattern including three rectangular unit figures K extending in the width direction of the intermediate transfer belt 51. Among these three types of blank seals 332*a* to 332*c*, the number of unit figures K constituting the blank seals 332*a* to 332*c* is different at each circumferential direction position, and thus the circumferential direction position of the intermediate transfer belt 51 can be identified. Thereby, in the image forming apparatus of the third embodiment, the position of the intermediate transfer belt 51 can be derived from the shapes of 332*a* to 332*c* of the unit figures K.

Three types of seals having different shapes are used for the blank seals 332*a* to 332*c*. The blank seals 332*a* to 332*c* are different from those in the first and second embodiments described above. Basically, first, the shape of the unit figures K themselves are a dimension of 1 cm in the axial direction of the photosensitive drums 1 and a dimension of 0.5 cm in the circumferential direction of the intermediate transfer belt 51. In a first position, one unit figure K is adhered. In a second position, two unit figures K are adhered with a space of 0.5 cm in between them. In a third position, three unit figures K are adhered with a space of 0.5 cm in between them. However, the shapes or patterns of the blank seals are not limited to those above. As discussed above with reference to FIG. 3B, an optical sensor is used as the reference position detection sensor 31, which functions as a "belt position mark detection sensor", which is the "second detection unit". Since the shape of each of the blank seals 332*a* to 332*c* is different, when the reference position detection sensor irradiates light on each of the three blank seals 332*a* to 332*c* described above, the number of reflections from the blank seals 332*a* to 332*c* changes. The reference position detection sensor 31 can distinguish between each of the blank seals 32 by the difference in the number of reflections.

Figure 6B:
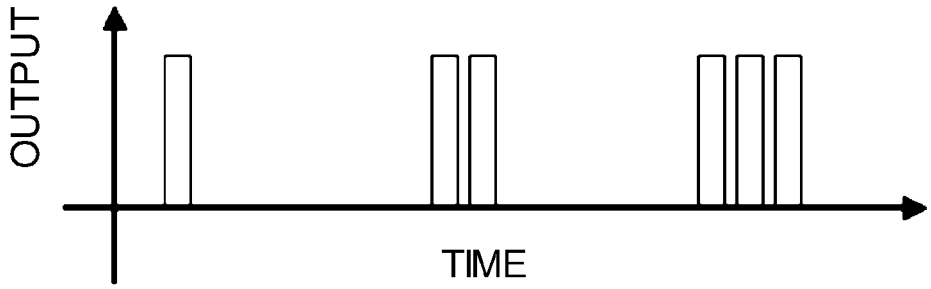

FIG. 6B is a graph illustrating the relationship of the pattern output from the reference position detection sensor 31 and the time. As illustrated in FIG. 5B, the output of the reference position detection sensor 31 corresponds to the dimensions of the blank seals 332 in the axial direction of the photosensitive drums 1, and the time of output corresponds to the dimensions of the blank seals 332 in the circumferential direction of the intermediate transfer belt 51.

According to the first to third embodiments, a plurality of blank seals are different from each other at each circumferential direction position. Therefore, even if the position calculation portion 50*b* loses the information of the circumferential direction position, it can recognize the closest circumferential direction position existing on the upstream side in the rotation direction of the intermediate transfer belt 51 to determine the position in the circumferential direction of the intermediate transfer belt 51. As a result, the time required for the controller to determine the position of the intermediate transfer belt 51 is reduced. Therefore, the reference position of the intermediate transfer belt 51 can be quickly detected, and the occurrence of a wait time can be eliminated by accurately distinguishing between the plurality of blank seals.

According to the first and second embodiments, the shapes or light reflectance of each of a plurality of blank seals is different, and thus the ability to identify the circumferential direction position of the intermediate transfer belt 51 is enhanced.

According to the third embodiment, the number of unit figures K constituting the blank seals 332*a* to 332*c* is different for each of the blank seals 332*a* to 332*c* at each position in the circumferential direction. Since the shapes of the seals are different, the ability to identify the circumferential direction position of the intermediate transfer belt 51 is enhanced.

In the first to third embodiments described above, one among the shape, light reflectance, and number of unit figures K constituting the blank seals is different for each of the blank seals 32, 232, 332 at each position in the circumferential direction, and thus the circumferential direction position of the intermediate transfer belt 51 can be identified. However, the present invention is not limited to these embodiments. Members having a magnet can also be used for the blank seals 32, 232, 332, and the plurality of blank seals 32, 232, 332 can be identified by the magnet.

In the first to third embodiments described above, an intermediate transfer system was described. However, the constitution of the present invention can also be applied to a mechanism utilizing a direct transfer system.

According to the present invention, a plurality of position marks differ from each other at each position in the circumferential direction. Therefore, even if the calculation unit loses the information of the circumferential direction position, it can recognize the closest circumferential direction position existing on the upstream side in the rotation direction of the belt member to determine the position in the circumferential direction of the belt member. As a result, the time required for the calculation unit to determine the position of the belt member is reduced.

Embodiments of the present invention were described above, but the present invention is not limited to the above embodiments, and any kind of modification can be made within the technical concept of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-179899, filed Jul. 31, 2009, which is hereby incorporated by reference herein in its entirety.

What is claimed is:

1. An image forming apparatus comprising:

a rotatable belt member;

a toner image forming unit which forms a toner image on the belt member;

a first detection unit which is arranged facing the belt member and detects the toner image transferred to the belt member;

a plurality of position marks which is provided in the plural points on the belt member in the circumferential direction of the belt member;

a second detection unit facing the belt member which detects the position marks;

a calculation unit which calculates the position in the circumferential direction of the belt member based on a detection result of the second detection unit; and an adjustment unit which adjusts toner image forming conditions of the toner image forming unit based on the output of the first detection unit and the circumferential direction position calculated by the calculation unit;

wherein the shape of the position marks is different from each other.

2. The image forming apparatus according to claim 1, wherein the shape of each of the position marks is different in the dimension in the circumferential direction of the belt member.

3. The image forming apparatus according to claim 1, wherein the shape of each of the position marks is different in the dimension in the width direction of the belt member.

* * * * *